United States Patent [19]

Muz

[11] Patent Number: 4,460,231

[45] Date of Patent: Jul. 17, 1984

[54] ELECTRICAL CONNECTOR

[75] Inventor: Edwin Muz, Reutlingen, Fed. Rep. of Germany

[73] Assignee: Nicolay GmbH, Kirchheim, Fed. Rep. of Germany

[21] Appl. No.: 349,591

[22] Filed: Feb. 17, 1982

[30] Foreign Application Priority Data

Feb. 23, 1981 [DE] Fed. Rep. of Germany ..... 3106594

[51] Int. Cl.[3] ..... H01R 11/22

[52] U.S. Cl. ..... 339/113 R; 339/218 R; 339/256 S; 339/276 T

[58] Field of Search ..... 339/113.2, 602, 226 R, 339/226 T, 258 R, 258 C, 256 C, 256 RT, 217 SP

[56] References Cited

U.S. PATENT DOCUMENTS

| | | | |
|---|---|---|---|
| 2,448,509 | 9/1948 | Antony et al. | 339/60 C X |
| 3,317,887 | 5/1967 | Henschen et al. | 339/276 T |
| 3,521,229 | 7/1970 | Spooren | 339/276 T |

FOREIGN PATENT DOCUMENTS

| | | | |
|---|---|---|---|
| 2428582 | 1/1976 | Fed. Rep. of Germany | 339/218 R |
| 7611106 | 10/1976 | Fed. Rep. of Germany . | |
| 7712845 | 8/1977 | Fed. Rep. of Germany . | |
| 2835400 | 2/1980 | Fed. Rep. of Germany | 339/218 R |
| 2045546 | 10/1980 | United Kingdom | 339/113 R |

*Primary Examiner*—Eugene F. Desmond
*Attorney, Agent, or Firm*—Walter C. Farley

[57] ABSTRACT

A connector for attachment to a stud having an enlarged head includes an annular slit spring element with a connection lug. The lug is attached to the wire to be electrically connected to the stud. The spring element has an annular portion of reduced diameter to engage the stud. The conductive parts are inclosed in a molded housing which is formed with a gap to permit expansion of the spring element.

5 Claims, 2 Drawing Figures

ELECTRICAL CONNECTOR

Figure 1:
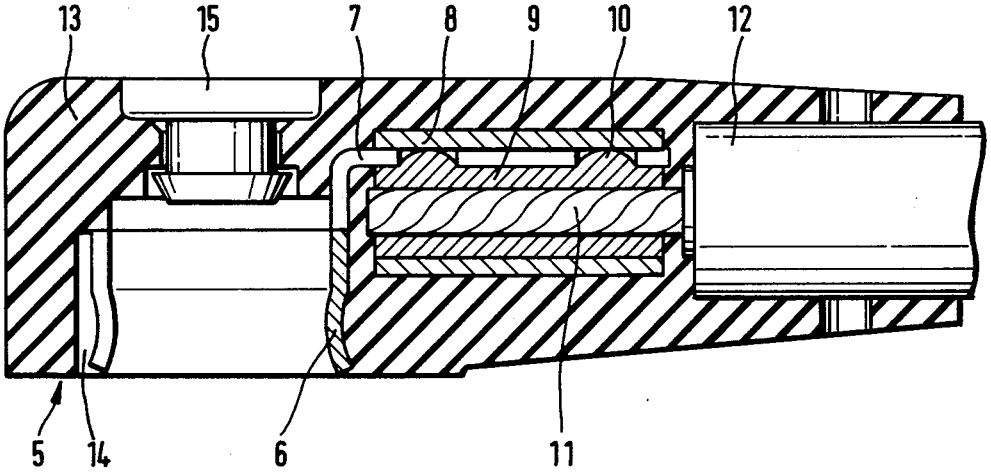

This invention relates to an electrical connector of the type used to establish connection between a conductor wire and a stud shaped male connector.

BACKGROUND OF THE INVENTION

In German utility Pat. No. 77 12 854 is shown a known electrical connector of the general type with which the invention is concerned in which the contact portion is formed as a thick-walled, hollow cylinder in which is disposed a catch spring arranged in such a way that the entire mechanism operates in the manner of a push button. Such a construction has the disadvantage that, when the connecting member is engaged, two contact points are switched one behind the other, one contact point being between the connecting member and the catch spring and the second contact point exists between the catch spring and the contact part.

Another known contact organ has two legs disposed at a distance from one another, the legs being interconnected by a transverse bridge wherein on the legs there is one holding part and between the legs there is a contact part. Such a type of construction is relatively expensive. This is shown in German utility Pat. No. 76 11 106.

BRIEF DESCRIPTION OF THE INVENTION

An object of the present invention is to provide a contact organ which forms a good electrical contact between the connecting member and a conducting wire and which can be handled easily when attaching or removing the connector.

Briefly described, the invention includes an electrical connector for forming an electrical connection between a conductor and a stud-shaped male contact member of the type having a head and a reduced-diameter portion behind the head, the connector comprising the combination of a female contact member comprising a generally cylindrical, conductive spring element for receiving said male contact member, said element having means therein defining an axially extending slit, a radially inwardly protruding portion adjacent one end of said spring element shaped to engage the reduced-diameter portion of said male contact member, and a connecting lug extending away from said spring element, means for joining said lug to the conductor, and electrically nonconductive means forming a housing body enclosing said female contact member, said means for joining and an end portion of the conductor and leaving exposed said one end of said spring element, said housing body including means defining a gap adjacent the portion of said spring element having said slit at least when said male element is not received in said spring element.

The desired good electric contact with the connecting member is established by the resilient part of the spring element and a good connection with the conductor is established by the connecting lug of the spring element. The spring element can be formed quite small and the connection of the connecting lug with the conductor requires only a small expenditure of space. As a result of the housing body being nonconductive, all metallic parts of the connector are covered toward the outside and only the spring element is exposed to be available for entry of the connecting member. The contact organ may thus be grasped by the housing body and can be put on or pulled off of the connecting member in a simple fashion.

Figure 2:
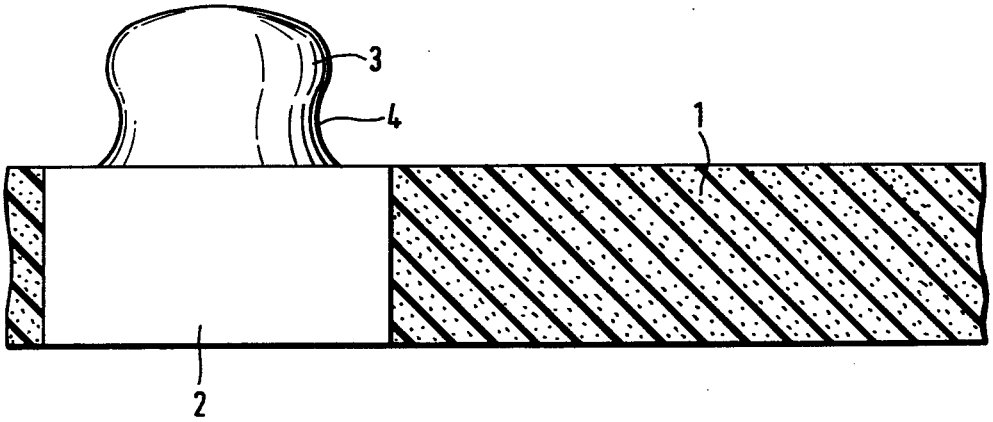

In order that the manner in which the foregoing and other other object are attained in accordance with the invention can be understood in detail, particularly advantageous embodiments thereof will be described with reference to the accompanying drawings, which form a part of the specification, and wherein:

FIG. 1 is a side elevation, in section, of an electrical connector in accordance with the invention; and FIG. 2 is a longitudinal section through a connecting member with which the apparatus of FIG. 1 can mate.

As seen in FIG. 2, a connecting member or electrode with which the connector of the present invention is attachable includes an attaching flange 1 which consists of an electrically nonconductive material such as foam rubber or paper. An electrode 2 is embedded in flange 1, the electrode being electrically conductive and being attached to a stud 3 which protrudes so as to be available for connection. It will be observed that the electrode 2 and stud 3 can be formed unitarily. It will also be observed that stud 3 is formed with a portion 4 which is undercut or formed with a reduced outer diameter, the diameter being less than that of the portion 3 of the stud which is spaced from electrode 2.

A contact arrangement in accordance with the present invention is shown in FIG. 1 and includes an annular spring element 6 which is formed from electrically conductive spring sheet material. The spring element is shaped so that its inside portion is adapted to conform to the outer surface of connecting stud 3 and therefore has an annular inwardly extending portion at the outer or lower end, as shown in the drawing, of the spring element. The spring element 6 is formed with a longitudinal slit **6*a* which, as will be evident in FIG. 1**, is characterized by omitted shading on the left hand side of the element.

The spring element also includes an integrally and unitarily formed connecting lug 7 which is bent at a right angle so as to project radially outwardly away from the spring element itself. Connecting lug 7 extends between two tubular connecting bodies 8 and 9 which are made of electrically conductive material. Connecting body 9 has a significantly smaller diameter than body 8 and includes on its outer surface two projections 10 which fit into openings in lug 7 provided for that purpose. As will be observed, the inner diameter of member 8 slips over and engages the outer surface of lug 7 and projections 10. The exposed electrically conductive portion 11 of the conductor which is to be electrically connected to stud 3 is received within body 9 and is electrically connected therewith, as by crimping, soldering, welding or the like, the remainder of the conductor being covered by an insulative jacket 12 in a conventional manner.

The spring element 6, the connecting bodies 8, 9 and that portion of the insulating jacket 12 which is adjacent to the connecting bodies is embedded in a housing body 13 which consists of a soft working material which is processable in an injection molding process. Thus, the assembled electrically conductive parts can be placed in a mold and the housing body 13 molded around those components, thus forming a holding part which permits the connector to be safely handled. Between the body 13 and that portion of the spring element 6 having the longitudinal slit **6*a* is a gap or space 14 which, in top plan view, would be approximately in the shape of a crescent or sickle, the gap being dimensioned so that when stud 3 is inserted into spring element 6** there is sufficient space to permit the spring element to properly expand. In order to provide this proper gap, the housing body can be molded onto the spring while the spring is in its tensioned or expanded condition.

Coaxially with the spring element is provided a marking body 15 which is made of an electrically nonconductive material and which is retained in a recess of the holding body by means of a catch connection. The marking body 15 can be marked on its exposed surface by a predetermined symbol or can be made of a material having a selected color. As will be recognized, body 15 is attached to housing body 13 after molding thereof and can be removed and replaced, if desired, to differently identify the connector.

While certain advantageous embodiments have been chosen to illustrate the invention it will be understood by those skilled in the art that various changes and modification can be made therein without departing from the scope of the invention as defined in the appended claims.

What is claimed is:

1. An electrical connector for forming an electrical connection between a conductor and a stud-shaped male contact member of the type having a head and a reduced-diameter portion behind the head, the connector comprising the combination of a female contact member comprising a generally cylindrical, conductive spring element for receiving said male contact member, said element having means therein defining a single axially extending slit forming an opening in said spring element, a radially inwardly protruding annular portion adjacent one end of said spring element shaped to engage the reduced-diameter portion of said male contact member, and a connecting lug unitarily formed on and extending away from the other end of said spring element;

means for joining said lug to the conductor; and electrically nonconductive means forming a housing body molded onto and integrally enclosing the assembly comprising said female contact member, said means for joining and an end portion of the conductor and leaving exposed said one end of said spring element, said housing body including means defining a radial gap adjacent the portion of said spring element having said slit at least when said male element is not received in said spring element so that said housing encloses and is in contact with the exterior of said spring element except in the area rear said slit.

2. A connector according to claim 1 and comprising a marking body; and means defining a recess in said housing on a surface facing away from said spring element for receiving and retaining said marking body.

3. An electrical connector for forming an electrical connection between a conductor and a stud-shaped male contact member of the type having a head and a reduced-diameter portion behind the head, the connector comprising the combination of a female contact member comprising a generally cylindrical, conductive spring element for receiving said male contact member, said element having means therein defining an axially extending slit forming an opening in said spring element, a radially inwardly protruding annular portion adjacent one end of said spring element shaped to engage the reduced-diameter portion of said male contact member, and a connecting lug extending away from the other end of said spring element;

means for joining said lug to the conductor including first and second tubular electrically conductive members of different diameters, said conductor being attached to the inside of the smaller of said members, and said lug being engaged between said first and second members; and electrically nonconductive means forming a housing body molded onto and enclosing the assembly comprising said female contact member, said means for joining and an end portion of the conductor and leaving exposed said one end of said spring element, said housing body including means defining a radial gap adjacent the portion of said spring element having said slit at least when said male element is not received in said spring element.

4. A connector according to claim 3 wherein said lug comprises an elongated member having longitudinally spaced openings therethrough, and the outer surface of the smaller of said first and second members includes projections positioned and dimensioned to extend into said spaced openings.

5. A connector according to claim 3 and comprising a marking body; and means defining a recess in said housing on a surface facing away from said spring element for receiving and retaining said marking body.

* * * * *